US005460233A

United States Patent [19]

Meany et al.

[11] Patent Number: 5,460,233

[45] Date of Patent: Oct. 24, 1995

[54] DIAMOND CUTTING STRUCTURE FOR DRILLING HARD SUBTERRANEAN FORMATIONS

[75] Inventors: Nigel C. Meany, Kincardineshire, Scotland; Craig H. Cooley, Bountiful; Gordon A. Tibbitts, Salt Lake City, both of Utah

[73] Assignee: Baker Hughes Incorporated, Houston, Tex.

[21] Appl. No.: 39,858

[22] Filed: Mar. 30, 1993

[51] Int. Cl.[6] ..... E21B 10/46

[52] U.S. Cl. ..... 175/428; 175/430; 175/432; 407/118

[58] Field of Search ..... 175/426, 428, 175/430, 432, 434; 407/118; 51/293, 307, 309

[56] References Cited

U.S. PATENT DOCUMENTS

| | | | |
|---|---|---|---|
| Re. 32,036 | 11/1985 | Dennis | 175/429 |
| 4,109,737 | 8/1978 | Bovenkerk | 175/430 |
| 4,244,432 | 1/1981 | Rowley et al. | 175/428 |
| 4,351,401 | 9/1982 | Fiedler | 175/428 |
| 4,382,477 | 5/1983 | Barr | 175/428 |
| 4,478,298 | 10/1984 | Hake et al. | 175/432 |
| 4,511,006 | 4/1985 | Grainger | 175/57 |
| 4,533,004 | 8/1985 | Ecer | 175/430 |
| 4,558,753 | 12/1985 | Barr | 175/431 |
| 4,607,711 | 8/1986 | Zijsling | 175/431 |
| 4,629,373 | 12/1986 | Hall | 407/118 |
| 4,705,123 | 11/1987 | Dennis | 175/428 |
| 4,727,945 | 3/1988 | Dennis | 175/432 |
| 4,792,001 | 12/1988 | Zijsling | 175/431 |
| 4,926,950 | 5/1990 | Zijsling | 175/430 X |
| 4,984,642 | 1/1991 | Renard et al. | 407/118 X |
| 4,987,800 | 1/1991 | Gasan et al. | 76/108.2 |
| 4,997,049 | 3/1991 | Tank et al. | 175/430 |
| 5,011,515 | 4/1991 | Furshour | 51/307 |
| 5,016,718 | 5/1991 | Tandberg | 175/333 |
| 5,025,874 | 6/1991 | Barr et al. | 175/430 |
| 5,037,451 | 8/1991 | Burnand et al. | 51/293 |
| 5,060,739 | 10/1991 | Griffin | 175/432 |
| 5,120,327 | 6/1992 | Dennis | 51/293 |
| 5,135,061 | 8/1992 | Newton, Jr. | 175/428 |
| 5,301,762 | 4/1994 | Besson | 175/379 |

FOREIGN PATENT DOCUMENTS

| | | | |
|---|---|---|---|
| 0322214 | 6/1992 | European Pat. Off. . | |
| 9011386 | 9/1990 | France . | |
| 2193740 | 2/1988 | United Kingdom . | |
| 2240797 | 8/1991 | United Kingdom . | |
| 9205335 | 2/1992 | WIPO | 175/432 |

*Primary Examiner*—David J. Bagnell
*Attorney, Agent, or Firm*—Trask, Britt & Rossa

[57] ABSTRACT

A rotary drag bit for drilling hard rock formations with substantially planar PDC cutting elements having diamond tables backed by substrates which flare or taper laterally outwardly and rearwardly of the cutting edge of the diamond table. A cutting structure defining a "lipped" cutting edge is also disclosed.

33 Claims, 6 Drawing Sheets

DIAMOND CUTTING STRUCTURE FOR DRILLING HARD SUBTERRANEAN FORMATIONS

BACKGROUND OF THE INVENTION

1. Field of the Invention

This invention relates generally to rotary drag bits for drilling subterranean formations, and more specifically to polycrystalline diamond compact (PDC) cutting structures for use with such rotary drag bits.

2. State of the Art

Fixed-cutter rotary drag bits have been employed in subterranean drilling for many decades, and various sizes, shapes and patterns of natural and synthetic diamonds have been used on drag bit crowns as cutting elements. Polycrystalline diamond compact (PDC) cutting elements, comprised of a planar diamond table formed under high temperature high pressure conditions onto a substrate typically of cemented tungsten carbide (WC), were introduced into the market about twenty years ago. PDC cutting elements, with their large diamond tables (usually of circular, semi-circular or tombstone shape), have provided drag bit designers with a wide variety of potential cutter deployments and orientations, crown configurations, nozzle placements and other design alternatives not previously possible with the smaller natural diamond and polyhedral, unbacked synthetic diamonds traditionally employed in drag bits. The planar PDC cutting elements have, with various bit designs, achieved outstanding advances in drilling efficiency and rate of penetration (ROP) when employed in soft to medium hardness formations, and the larger cutter dimensions and attendant greater protrusion or extension above the bit crown have afforded the opportunity for greatly improved bit hydraulics for cutter lubrication and cooling and formation debris removal. The same type and magnitude of advances in drag bit design for drilling rock of medium to high compressive strength have, unfortunately, not been realized.

State-of-the-art planar, substrate-supported PDC cutting elements have demonstrated a notable susceptibility to spalling and fracture of the PDC diamond layer or table when subjected to the severe downhole environment attendant to drilling rock formations of moderate to high compressive strength, on the order of nine to twelve kpsi and above, unconfined. Engagement of such formations by the PDC cutting elements occurs under high weight on bit (WOB) required to drill such formations and high impact loads from torque oscillations. These conditions are aggravated by the periodic high loading and unloading of the cutting elements as the bit impacts against the unforgiving surface of the formation due to drill string flex, bounce and oscillation, bit whirl and wobble, and varying WOB. High compressive strength rock, or softer formations containing stringers of a different, higher compressive strength, thus generally produces severe damage to, if not catastrophic failure of, the PDC diamond tables. Furthermore, bits are subjected to severe vibration and shock loads induced by movement during drilling between rock of different compressive strengths, for example, when the bit abruptly encounters a moderately hard strata after drilling through soft rock.

Severe damage to even a single cutter on a PDC cutting element-laden bit crown can drastically reduce efficiency of the bit. If there is more than one cutter at the radial location of a failed cutter, failure of one may soon cause the others to be overstressed and to fail in a "domino" effect. As even relatively minor damage may quickly accelerate the degradation of the PDC cutting elements, drilling operators as a whole have lacked confidence in PDC cutting element drag bits for hard and stringer-laden formations.

It has been recognized in the art that the sharp, typically 90° edge of an unworn, conventional PDC cutting element is usually susceptible to damage during its initial engagement with a hard formation, particularly if that engagement includes even a relatively minor impact. It has also been recognized that pre-beveling or pre-chamfering of the PDC diamond table cutting edge provides some degree of protection against cutter damage during initial engagement with the formation, the PDC cutting elements being demonstrably less susceptible to damage after a wear flat has begun to form on the diamond table and substrate.

U.S. Pat. Nos. Re 32,036, 4,109,737, 4,987,800, and 5,016,718 disclose and illustrate bevelled or chamfered PDC cutting elements as well as alternative modifications such as rounded (radiused) edges and perforated edges which fracture into a chamfer-like configuration. Co-pending U.S. patent application Ser. No. 893,704, filed Jun. 5, 1992, assigned to the assignee of the present application and incorporated herein by this reference, discloses and illustrates a multiple-chamfer PDC diamond table edge configuration which, under some conditions exhibits even greater resistance to impact-induced cutter damage.

However, even with the PDC cutting element edge configuration modifications recently employed in the art, cutter damage remains an all-too-frequent occurrence when drilling formations of moderate to high compressive strengths and stringer-laden formations. As a result, PDC cutting element drag bits are still employed less frequently than might be desired in drilling such formations in light of their aforementioned advantages due to the continued lack of confidence in their durability.

It would be desirable to provide a PDC cutting element with better protection against damage during the first part of a run, before the protective wear flat forms, and to maintain the pristine cutting edge in its original state until useful engagement with the formation is commenced. By prohibiting or significantly reducing initiation and propagation of diamond table fracture when the bit gets to the bottom of the borehole, the new, sharp, undamaged cutting edges can usefully engage the formation and develop protective wear flats which will inhibit damage during the remainder of the run. Thus, cutter life would be enhanced and prolonged.

SUMMARY OF THE INVENTION

In contrast to the prior art, the present invention provides an extremely robust PDC cutting structure exhibiting enhanced resistance to damage from downhole phenomena experienced during drilling.

The present invention comprises, in an embodiment employing a circular PDC diamond table, a diamond table supported or backed by a substrate of frustoconical configuration tapering or flaring rearwardly and outwardly from a smaller diameter adjacent the diamond table to a larger diameter which may terminate at the trailing rear surface of the substrate, or reach the larger, outer diameter of the substrate ahead of the rear surface. The rear or trailing surface of the substrate is typically secured, as by brazing, to a stud or cylinder carrier element which, in turn, is secured to the face of the bit crown.

The tapered substrate design, when employed in a PDC cutting structure on the bit face, results in a measurable reduction in the drilling-induced stress on the PDC cutting element. Under conditions experienced in drilling moderate to high compressive strength rock, wherein the PDC cutting elements experience combination loading, that is simultaneous high vertical and high horizontal loading (taken with respect to the bit's path), stress reductions resulting from the present invention approach fifty percent. Stated another way, under high torque and high WOB far exceeding that sustainable by conventional PDC cutting elements, chamfered, flared or tapered substrate PDC cutting elements according to the present invention sustain little or no damage.

The flare, chamfer or taper provided by the frustoconical substrate provides a reinforcement behind the PDC diamond table which, particularly under normal orientation (backrake) of the cutting element for drilling, provides support for the diamond table against loads in the cutting direction, or direction of bit rotation adjusted for ROP.

In one embodiment of the invention, the substrate is not only tapered, but slightly grooved or undercut immediately behind the diamond table, a configuration which appears to provide a sharper, more efficient, while still fairly durable, cutting edge comparable to the tapered substrate or buttressed PDC cutting element without such a feature, which may be described as a "lip."

While the preferred embodiment employs a circular PDC diamond table, a half-circular diamond table with a half-frustoconical (diametrically divided) substrate is also contemplated, as is the use of smaller arcuately-bounded PDC segments, so-called "tombstone" cutters with rectangular diamond tables having a curved outer edge, and other, such as rectangular, diamond table shapes. Other substantially planar diamond tables, such as ridged or convex or concave tables, may also benefit from a substrate according to the present invention. It should also be noted that the taper or flare of the substrate may be nonlinear, and located behind only a circumferential segment or portion of the diamond table, such as a 90° or 120° segment intended by design to initially engage the formation.

It is believed that a major aspect of the present invention, regardless of the specific diamond table shape, is the rearward and outward taper or flare of the carbide substrate beyond the cutting edge of the diamond table to provide the aforementioned relief and reinforcement thereof. Use of a "lipped" cutting element, with or without the tapered substrate, is also considered to be another significant aspect of the invention.

DETAILED DESCRIPTION OF THE PREFERRED EMBODIMENTS

Figure 1:
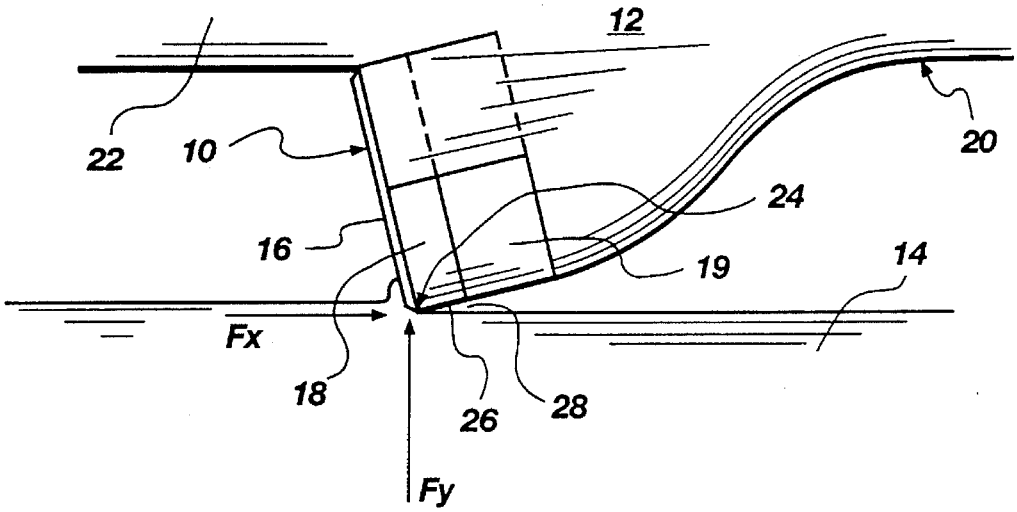
Fig. 1 (PRIOR ART)
FIG. 1 is a side elevation of a prior art PDC cutting element employing a truncated cylindrical substrate mounted on a bit face.

Referring now to FIG. 1 of the drawings, a prior art cutting element 10 is depicted mounted on the face of a bit 12 in the process of cutting a formation 14. The cutting element 10, having a circular PDC diamond table 16 backed by a cemented tungsten carbide (WC) substrate 18 in the shape of a truncated cylinder or disk, is secured to a cylindrical carrier element 19 embedded in the face 20 of a matrix-type bit body 22, all as known in the art. The combined loading on the cutting element 10 from bit rotation and engagement with the formation 14 (Fx) and WOB (Fy) is quite substantial, particularly in rock formations of moderate to high compressive strength. The cutting edge 24 of diamond table 16 at the outermost protrusion (from the bit face 20) of cutting element 10 is the area, and in new cutting elements, initial point of contact between the cutting element 10 and formation 14. As a result, the already substantial forces Fx and Fy are concentrated on an incredibly small area, which may not even be spread over the total numbers of cutting elements on the bit face in the initial stages of drilling. As previously noted, drillstring flex, bounce, oscillation and vibration and bit bounce, wobble and whirl may cause cyclic impact loading of the cutting elements, aggravating the loading problem.

It can easily be seen and readily appreciated that a conventional cutting element 10, backracked for cutting as is generally practiced in the art, provides little or no useful support for cutting edge 24 of diamond table 16 against Fx, as substrate 18, with constant diameter outer side or peripheral surface 26, does not extend behind diamond table 16 for any appreciable depth due to the backrake of the cutting element 10. There is thus a gap 28 immediately behind diamond table 16 at cutting edge 24 looking along the x-plane, and it can be seen that the substantially unsupported outer extent diamond table 16 is susceptible to chipping, spalling and fracture due to the drilling-induced loads in that area. While cutting edge 24 may be chamfered, multiple-chamfered, rounded, perforated or serrated to reduce the tendency for catastrophic diamond table damage, the overall structural inadequacy of such prior art cutting elements is still all too apparent.

Figure 2:
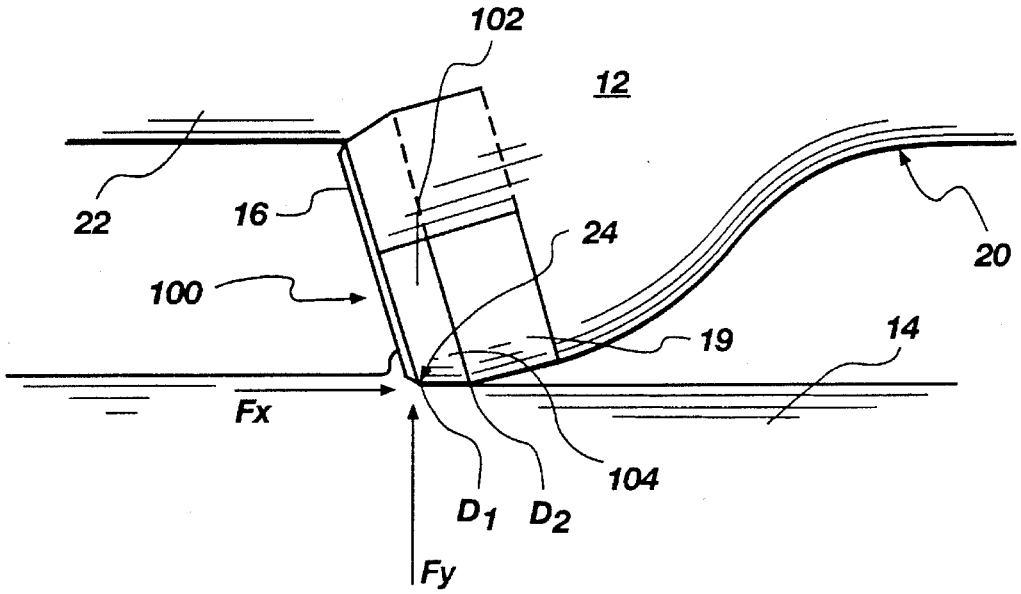
FIG. 2 is a side elevation of a circular, planar PDC cutting element having a frustoconical substrate according to the present invention mounted on a bit face.

Referring now to FIG. 2 of the drawings, a first preferred embodiment 100 of a cutting element according to the present invention is depicted in the same position and orientation as cutting element 10 of FIG. 1, cutting the same formation 14. As many elements of FIG. 2 (and subsequent figures) are the same as those of FIG. 1, they will be identified with the same reference numerals for purposes of clarity.

Figure 12:
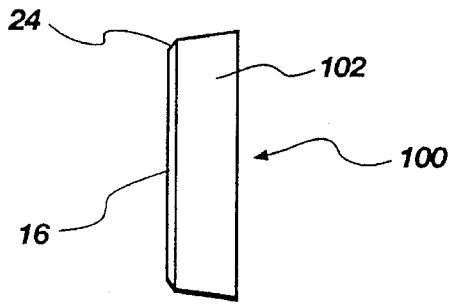
FIG. 12 is a side elevation of a cutting element according to the present invention having a chamfered cutting edge.
Figure 13:
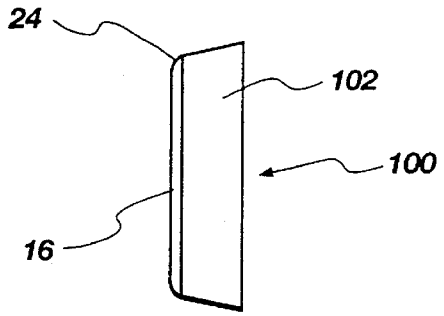
FIG. 13 is a side elevation of a cutting element according to the present invention having a rounded cutting edge.

Cutting element 100 includes a substantially circular PDC diamond table 16 with cutting edge 24, preferably chamfered or rounded as known in the art, and as respectively illustrated in FIGS. 12 and 13 of the drawings. WC substrate 102, however, is of tapered configuration, extending from a first diameter $D_1$ adjacent diamond table 16, which closely approximates that of the latter, to a larger, second diameter $D_2$ at its full depth to the rear of diamond table 16. In the case of cutting element 100, substrate 102 is shaped as a truncated cone, or frustoconically, with the smaller circular front surface thereof carrying diamond table 16. The rear circular surface of substrate 102 is secured, as by brazing, to cylindrical carrier element 19 on bit face 20. It will be appreciated, as illustrated in later drawing figures, that the flare or tapered side surface of the substrate may reach diameter $D_2$ at the side of the substrate ahead of the rear surface, in this instance the remainder of the substrate side surface being cylindrical.

It can be seen that substrate 102 provides support against Fy forces in the same manner as prior art substrate 18, but is far superior thereto in supporting diamond table 16 adjacent cutting edge 24 against Fx forces. This is due to the outward taper or flare of substrate 102 in combination with the backrake of cutting element 10, providing in effect a reinforcement in outer substrate area 104 which supports the outer portion of diamond table 16, significantly reducing the stresses therein.

Even without the backrake of the cutting element providing effectively "more" substrate material behind diamond table 16, finite element analysis (FEA) techniques have indicated a significant, measurable stress reduction in the cutting edge area of a chamfered diamond table when a 10° by 0.080 inch depth tapered substrate is employed. This reduction becomes phenomenal, on the order of 50%, when combination loading on such a cutting element (about 60° from the direction of cut) is simulated to approximate extremely high compressive strength rock drilling.

Severe drop tests have been conducted on 15° taper by 0.080 inch depth 13 mm diameter cutting elements at 20° backrake, conventional commercially-available, state-of-the-art PDC elements being modified for this purpose. Such tests were run in comparison to unmodified cutters, and it was found to be so difficult to damage the tapered cutting elements that it was necessary to conduct the drop tests in Barre granite, Ruby red granite, Rib mountain granite, and quartzite, such extremely hard rock having compressive strengths from about 30 to 70 kpsi. After fifteen drops, the only cutting element to withstand the drop series without damage was the tapered cutter.

Drilling tests have also been conducted with a Hughes Christensen RC 472 (4.380×2.400) core bit equipped with 13 mm, 15° by 0.080 inch tapered substrate cutting elements. The tests were run in Topapah Springs and Tiva Canyon tuffs, both having compression strengths of 25 to 35 kpsi. Tests of this type normally do not exceed 10,000 to 12,000 lbf WOB because WOB's in excess of 10,000 lbf damage the cutters. In these tests, extreme weights and torques were applied before any damage was noticed. The test bit was undamaged after running at 16,000 lbf WOB and 4,000 ft-lbf torque. After a trial test at 22,000 lbf WOB and 5,000 ft-lbf of torque, only one cutter was significantly damaged.

Further tests were conducted using a Hughes Christensen 8½" AR 435 bit with seventeen 13 mm tapered cutters and nineteen 13 mm standard cutters, the tapered cutters having 10° by 0.080 inch depth substrates. Tests were conducted in Catoosa Shale, Bedford limestone and Carthage marble. Standard design backrakes were employed. The tests indicated, surprisingly, that the tapered cutter bit drilled just as fast to slightly faster in these rocks than identical bits equipped with conventional cutters.

Thus, FEA and empirical testing have each demonstrated that tapered substrate PDC cutting elements provide a significant durability advantage, with no loss of cutting performance, over conventional cutting elements, and that significant advance in ROP through hard rock can be achieved due to the tapered cutters' ability to accommodate extraordinary torque and WOB.

FIGS. 3–7 of the drawings depict alternative embodiments of cutting elements according to the present invention.

Figure 3:
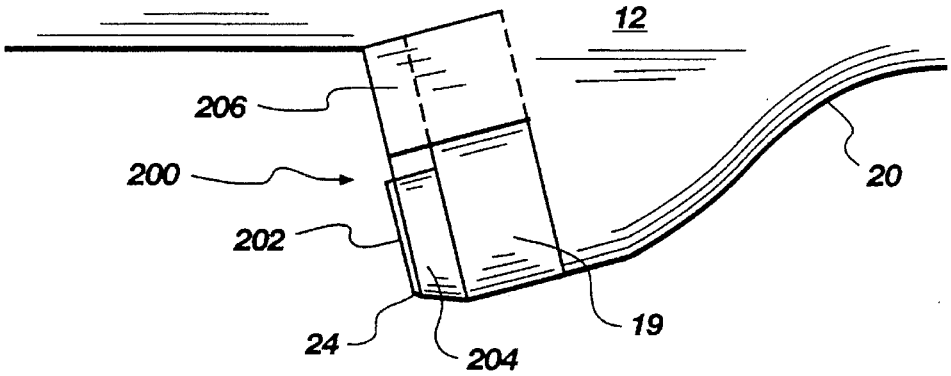
FIG. 3 is a side elevation of a semi-circular, planar PDC cutting element having a half-frustoconical substrate according to the present invention.

FIG. 3 depicts a "half-round" cutting element 200 having an approximately semi-circular diamond table 202 backed by a half-frustoconical substrate 204. That is to say, substrate 204 approximates a frustoconical structure cut diametrically. A half-round WC blank 206 may be placed adjacent diamond table 202 to provide a wear surface against abrasive-laden drilling mud and formation cuttings coming off of diamond table 202.

Figure 4:
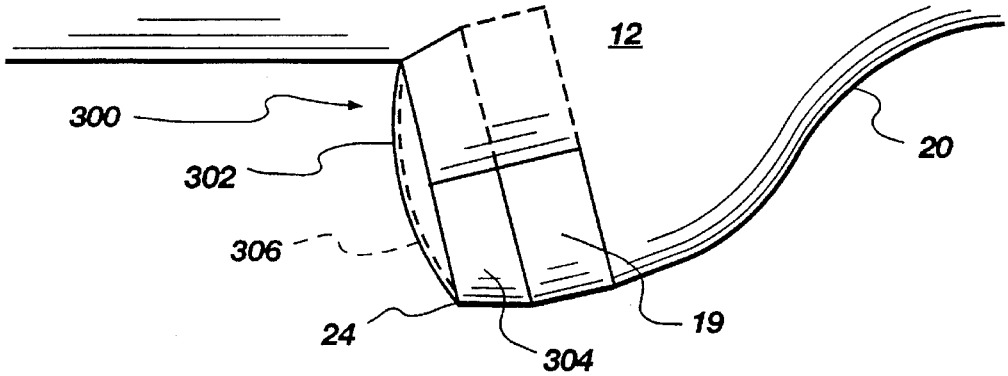
FIG. 4 is a side elevation of a convex, circular PDC cutting element according to the present invention.

The cutting element 300 of FIG. 4 comprises a convex diamond table 302 on a frustoconical substrate 304. Substrate 304 may have a convex leading face 306, as shown in broken lines, and a constant depth diamond table deposited thereon, such as a CVD-applied diamond film. Alternatively, the diamond table 302 may be thicker in the center, may include internal or external protrusions or ridges of parallel, radial or other orientation, or may otherwise be of nonuniform thickness.

Figure 5:
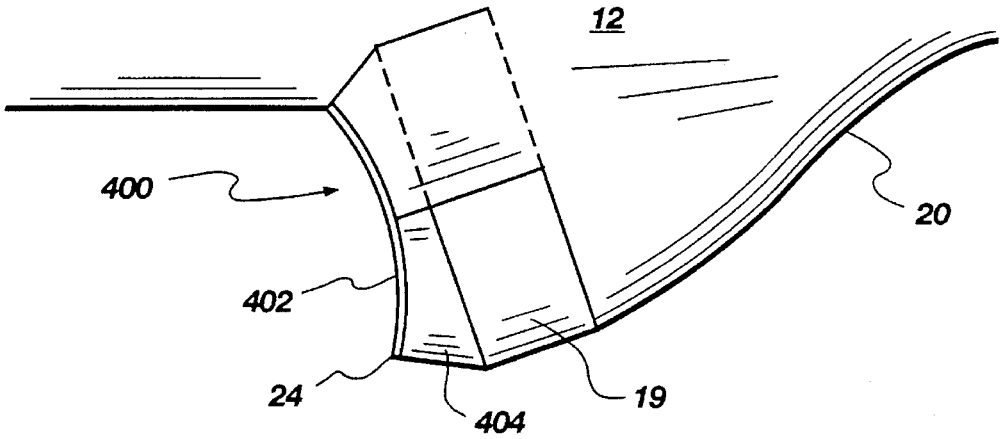
FIG. 5 is a side elevation of a concave, circular PDC cutting element according to the present invention.

FIG. 5 depicts a cutting element 400 with concave diamond table 402 on a dished or concave leading face substrate 404.

Figure 6:
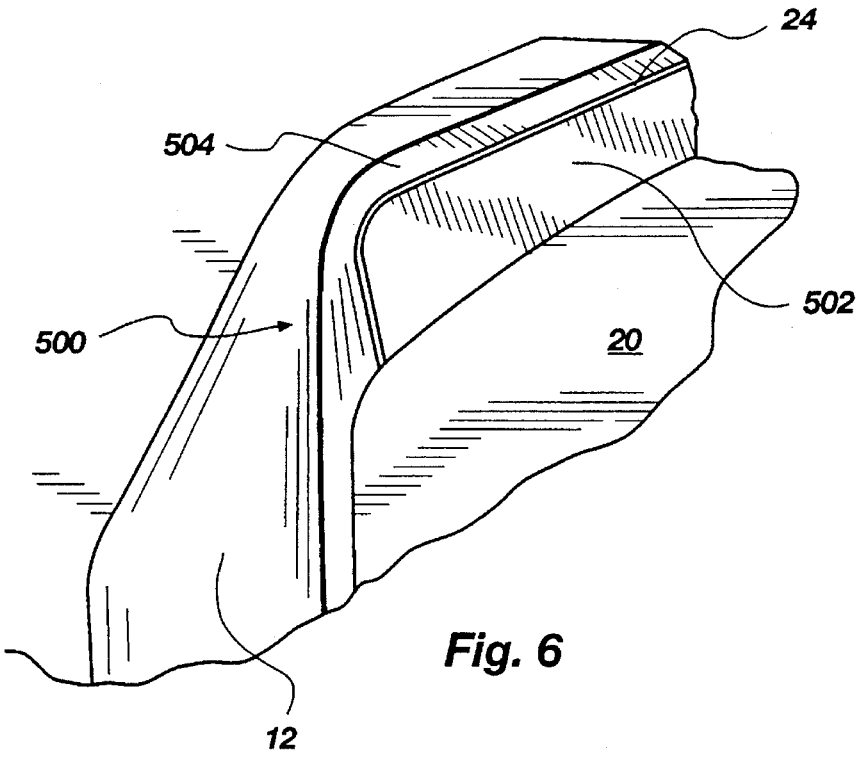
FIG. 6 is a perspective view of a blade-type cutting element according to the present invention.

FIG. 6 depicts an inverted partial perspective of a blade-type cutting structure 500, diamond table 502 comprising a plurality of PDC plates or segments, or a diamond film, and tapered substrate 504 comprising either the adjacent PDC substrates ground to a taper or a single tapered element to which the diamond table 502 is affixed or applied.

Figure 7:
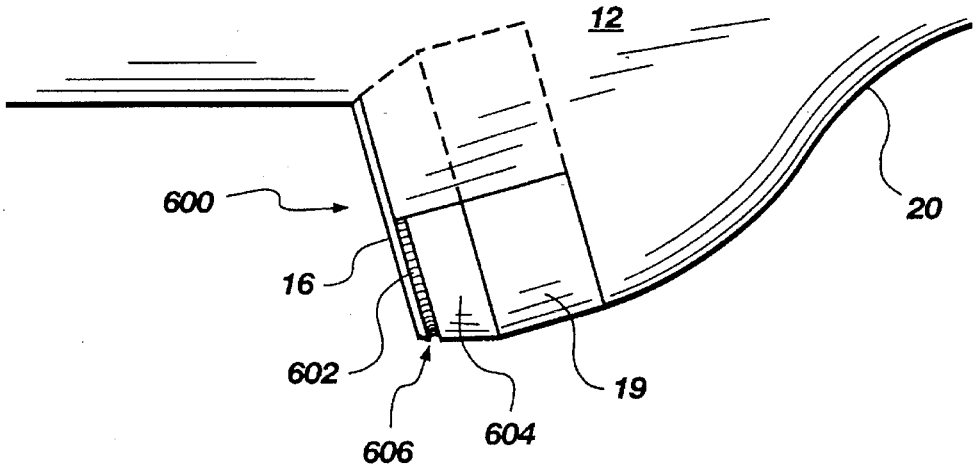
FIG. 7 is a side elevation of a PDC cutting element according to the present invention having a lip-like cutting edge.

FIG. 7 depicts a cutting element 600 similar to that of FIGS. 2 and 3, wherein a narrow, shallow groove or undercut 602 (exaggerated in the drawing) has been machined or otherwise formed in the material of substrate 604 behind diamond table 16. The groove or undercut provides a lip-like cutting edge 606 for cutting element 600, such a structure being sharper and thus more efficient than a conventional configuration, and being structurally possible without cutting element damage due to the tapered or flared substrate 604.

Figure 7A:
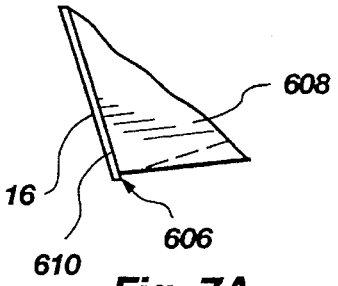
FIGS. 7A–7D are partial side elevations of alternative cutting element configurations which define a lip.
Figure 7B:
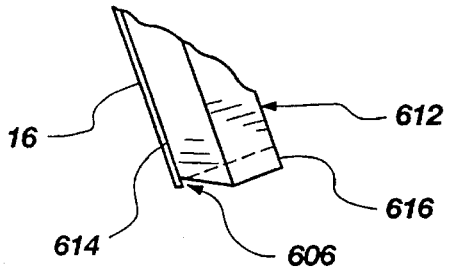
Figure 7C:
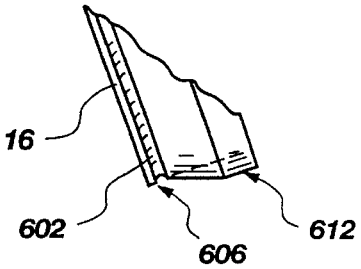
Figure 7D:
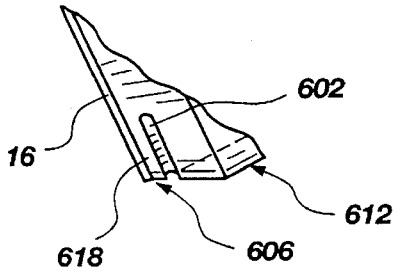

In lieu of grooving the substrate, to form a lip a substrate 608 having a leading face 610 slightly smaller than the diamond table may be machined or otherwise formed to flare continuously outwardly and rearwardly from the diamond table, as shown in FIG. 7A. FIG. 7B depicts a substrate 612, which is of slightly smaller diameter at its leading face 614 than diamond table 16 but, unlike the embodiment of FIG. 7A, substrate 612 flares or tapers outwardly to its full diameter before reaching its back or trailing face 616. FIG. 7C depicts a combination of features previously described, including groove or undercut 602 formed in a substrate 612 which extends to its full diameter before reaching its full depth. FIG. 7D depicts a cutting element similar to that of FIG. 7C, but having groove or undercut 602 rearwardly displaced from and separated by an area of intervening substrate material 618. It should be observed that groove 602 in FIG. 7D extends about only a portion of the circumference of diamond table 16, a feature that may be employed regardless of the location of groove 602 on the substrate. It should also be noted that a diamond table may be employed with a grooved or slightly smaller cylindrical (untapered) substrate, if desired, as shown in broken lines on FIGS. 7A–7D, to define the lip structure.

Figure 8A:
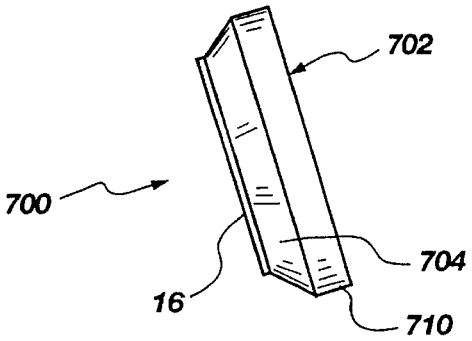
FIGS. 8A and 8B are side elevations of PDC cutting elements according to the present invention with substrates having non-linear flared or tapered side surfaces.
Figure 8B:
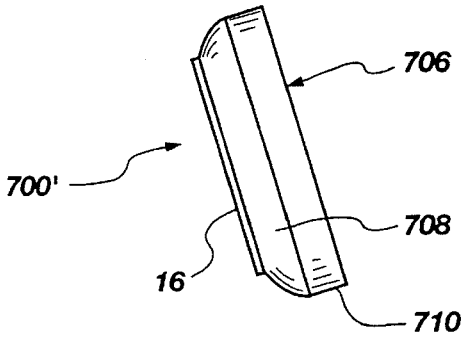

FIGS. 8A and 8B depict embodiments 700 and 700' of the cutting element of the present invention. In FIG. 8A, diamond table 16 is backed by a substrate 702 having a flared or tapered outer side surface 704 of concave configuration, in lieu of the straight taper, chamfer or bevel previously disclosed. FIG. 8B depicts a substrate 706 having convex flared or tapered outer side surface 708. The embodiments of both FIGS. 8A and 8B depict a flare or taper reaching the full diameter or outer extent 710 of the substrate partway between its leading and trailing faces.

Figure 9:
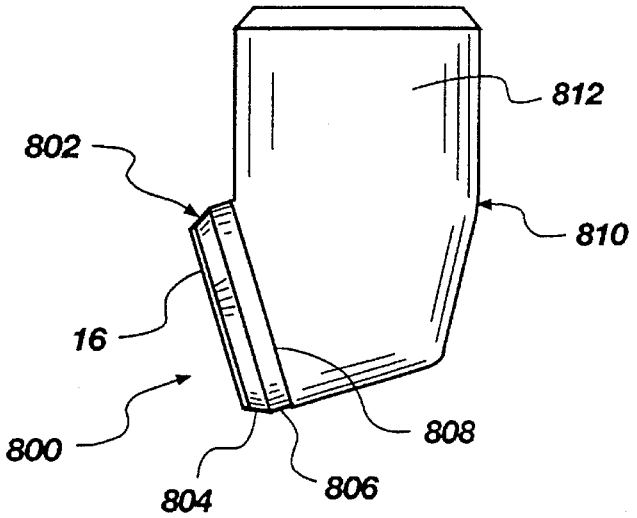
FIG. 9 depicts a cutting element according to the present invention mounted on a stud-type carrier element.

FIG. 9 illustrates a cutting element 800 according to the present invention including diamond table 16 on substrate 802, the latter having flared outer side surface 804 leading to cylindrical outer side surface 806. The trailing face 808 of cutting element 800 is secured to a stud 810, which can be affixed to a bit by insertion of its inner end 812 into an aperture in the bit face and secured by brazing, a press fit, or other means known in the art.

Figure 10A:
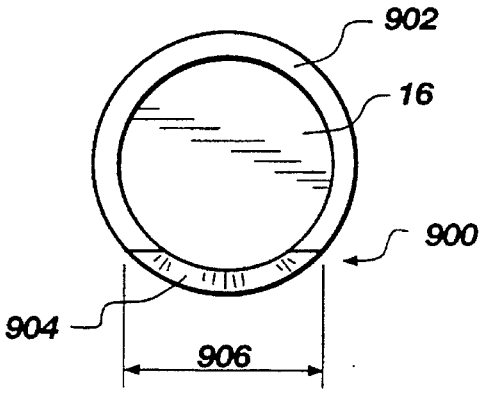
FIGS. 10A, 10B, 11A and lib show front and side elevations of cutting elements according to the present invention having only partially circumferentially flared or tapered substrates.
Figure 10B:
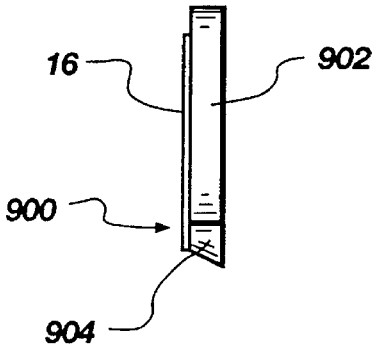

FIGS. 10A and 10B depict a cutting element 900 wherein the flared or tapered part 904 of substrate 902 extends only about a circumferential portion or segment 906 of the cutting element. Segment 906 is then placed and oriented on the bit face to engage the formation being drilled.

Figure 11A:
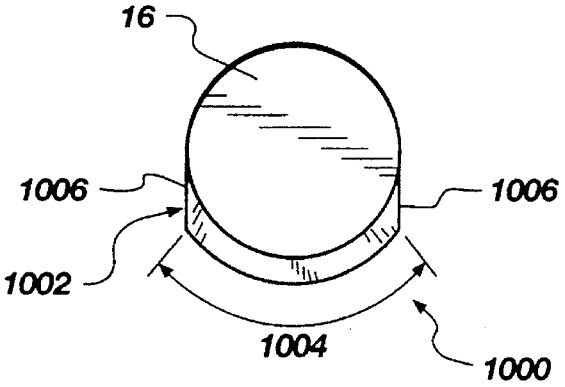
Figure 11B:
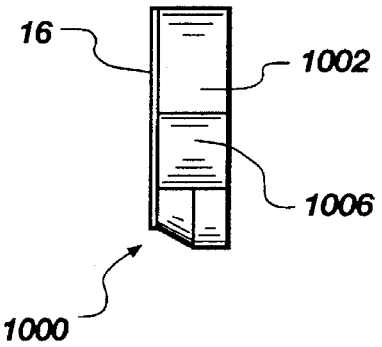

FIGS. 11A and 11B depict another cutting element 1000, again having only a flared or tapered circumferential side segment 1004 of substrate 1002, in this instance extending into side flats 1006 on each side of substrate 1002, the flats 1006 permitting greater ease of rotational orientation of cutting element 1000 on a carrier element. A partial circumferential groove as previously described can, of course, be combined with a partial circumferential flare or taper, if desired.

Figure 14:
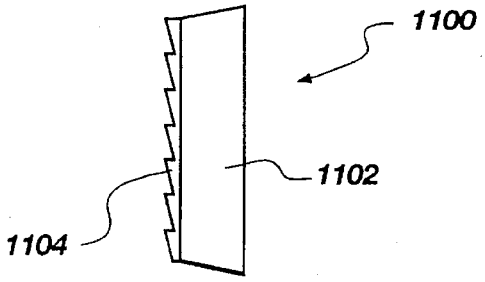
FIG. 14 is a side elevation of a cutting element according to the present invention having a diamond table with a ridged cutting surface.
Figure 15:
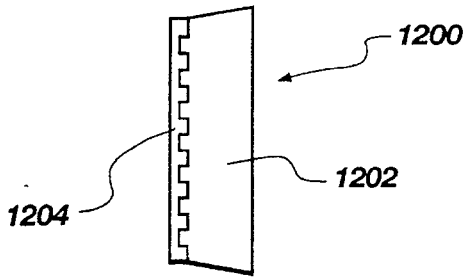
FIG. 15 is a side elevation of a cutting element according to the present invention having a diamond table of nonuniform thickness.

It will also be appreciated that other substantially planar diamond table configurations may be employed in cutters according to the present invention. For example, a ridged or serrated cutting surface, as disclosed in U.S. Pat. Nos. 4,629,373, 4,984,642 and 5,037,451, can be employed. Such a configuration is illustrated in FIG. 14 by cutting element 1100 having a ridged cutting surface on diamond table 1104, which is supported by substrate 1102. Other variable-depth diamond table designs are disclosed in U.S. Pat. Nos. 4,997,049, 5,011,515 and 5,120,327, in European Patent No. 0322214 and in co-pending U.S. application Ser. No. 016,085, now U.S. Pat. No. 5,351,772, filed on Feb. 10, 1993, the latter assigned to the assignee of the present invention and incorporated herein by this reference. Such a configuration in a cutting element according to the present invention is illustrated in FIG. 15 by cutting element 1200 having a nonuniform thickness diamond table 1204 supported by substrate 1202.

Different superhard table materials may be employed, such as thermally stable PDC's, commonly called TSP's, diamond films, or cubic boron nitride.

The cutting element of the present invention may be mounted to cylindrical or stud carrier elements as shown, to an elongated stud, directly to the bit face, or by any other means known or contemplated by the art.

Thus, it will be readily apparent to those of ordinary skill in the art that the present invention, although disclosed in terms of preferred and alternative embodiments, is not so limited and that the aforementioned and other additions, deletions and modifications may be made to the invention within the scope of the following claims.

What is claimed is:

1. A cutting element for a rotary drag bit used in drilling subterranean formations comprising:

a substantially planar table of superhard material, said superhard table having a flat cutting surface on one side thereof and a cutting edge bordering said cutting surface along at least a portion of the periphery thereof; and a substrate behind, secured to and supporting said superhard table at a side thereof opposite said cutting surface, said substrate being of no greater lateral extent than said superhard table proximate said cutting edge and increasing in lateral extent beyond said cutting edge as said substrate extends rearwardly from said superhard table.

2. The cutting element of claim 1, wherein said superhard table is substantially circular, and said substrate is substantially frustoconical.

3. The cutting element of claim 1, wherein said superhard table is substantially semicircular, said cutting edge is comprised of an arcuate segment of the boundary of said semi-circle, and said substrate is half-frustoconical.

4. The cutting element of claim 1, wherein said substrate flares or tapers laterally outwardly and rearwardly from said superhard table cutting edge in a substantially continuous manner.

5. The cutting element of claim 1, wherein at least a portion of said substrate behind said cutting edge is of slightly smaller lateral extent than said superhard table, so to define a lip.

6. The cutting element of claim 1, wherein said superhard table comprises a PDC.

7. The cutting element of claim 1, wherein said cutting edge is chamfered.

8. The cutting element of claim 1, wherein said cutting edge is rounded.

9. The cutting element of claim 1, wherein said superhard table is of nonuniform thickness.

10. The cutting element of claim 1, further comprising a carrier element to which the rear of said substrate is secured.

11. The cutting element of claim 10, wherein said carrier element comprises a cylinder.

12. The cutting element of claim 10, wherein said carrier element comprises a stud.

13. A fixed-cutter rotary drag bit for drilling subterranean formations, comprising:

a shank;

a bit crown secured to said shank and having a face opposite thereto; and at least one superhard cutting element secured to said crown face;

said at least one superhard cutting element comprising a substantially planar table of superhard material having a flat cutting surface and a cutting edge along at least a portion of the periphery of said cutting surface, and a supporting substrate to the rear of said superhard table, the outer lateral dimension of said substrate being no greater than that of said superhard table proximate said cutting edge and extending laterally outwardly and rearwardly behind said cutting edge.

14. The rotary drag bit of claim 13, wherein said superhard table is substantially circular, and said substrate is substantially frustoconical.

15. The rotary drag bit of claim 13, wherein said superhard table is substantially semicircular, said cutting edge is comprised of an arcuate segment of the boundary of said semi-circle, and said substrate is half-frustoconical.

16. The rotary drag bit of claim 13, wherein said substrate flares or tapers laterally outwardly and rearwardly from said diamond table cutting edge in a substantially continuous manner.

17. The rotary drag bit of claim 13, wherein at least a portion of said substrate behind said cutting edge is of slightly smaller lateral extent than said superhard table, so to define a lip.

18. The rotary drag bit of claim 13, further including a carrier element secured to said bit crown face and to which said substrate is secured.

19. The rotary drag bit of claim 18, wherein said carrier element comprises a cylinder, and the rear of said substrate is secured to one end of said cylinder.

20. The rotary drag bit of claim 18, wherein said carrier element comprises a stud inserted in an aperture in said bit face, and the rear of said substrate is secured to said stud.

21. The cutting element of claim 13, wherein said superhard table comprises a PDC.

22. The rotary drag bit of claim 13, wherein said substrate extends laterally outwardly and rearwardly behind said superhard table cutting edge in a substantially continuous manner.

23. The rotary drag bit of claim 13, wherein said superhard table is of nonuniform thickness.

24. A cutting element for a rotary drag bit used in drilling subterranean formations, comprising:

a substantially planar table of superhard material having a cutting edge; and a substrate behind and supporting said superhard table and including at least a portion having a smaller lateral extent than said superhard table so as to define a lip associated with said cutting edge, said substrate flaring or tapering outwardly and rearwardly from said cutting edge.

25. The cutting element of claim 24, wherein said superhard table comprises a PDC.

26. A cutting element for a rotary drag bit used in drilling subterranean formations comprising:

a substantially planar table of superhard material, said superhard table having a cutting surface on one side thereof and a rounded cutting edge bordering said cutting surface along at least a portion of the periphery thereof; and a substrate behind, secured to and supporting said superhard table at a side thereof opposite said cutting surface, said substrate being of no greater lateral extent than said superhard table proximate said cutting edge and increasing in lateral extent beyond said cutting edge as said substrate extends rearwardly from said superhard table.

27. A cutting element for a rotary drag bit used in drilling subterranean formations comprising:

a substantially planar table of superhard material, said superhard table being of nonuniform thickness and having a cutting surface on one side thereof and a cutting edge bordering said cutting surface along at least a portion of the periphery thereof; and a substrate behind, secured to and supporting said superhard table at a side thereof opposite said cutting surface, said substrate being of no greater lateral extent than said superhard table proximate said cutting edge and increasing in lateral extent beyond said cutting edge as said substrate extends rearwardly from said superhard table.

28. A cutting element for a rotary drag bit used in drilling subterranean formations comprising:

a substantially planar table of superhard material, said superhard table having a convex cutting surface on one side thereof and a cutting edge bordering said cutting surface along at least a portion of the periphery thereof; and a substrate behind, secured to and supporting said superhard table at a side thereof opposite said cutting surface, said substrate being of no greater lateral extent than said superhard table proximate said cutting edge and increasing in lateral extent beyond said cutting edge as said substrate extends rearwardly from said superhard table.

29. A cutting element for a rotary drag bit used in drilling subterranean formations comprising:

a substantially planar table of superhard material, said superhard table having a ridged cutting surface on one side thereof and a cutting edge bordering said cutting surface along at least a portion of the periphery thereof; and a substrate behind, secured to and supporting said superhard table at a side thereof opposite said cutting surface, said substrate being of no greater lateral extent than said superhard table proximate said cutting edge and increasing in lateral extent beyond said cutting edge as said substrate extends rearwardly from said superhard table.

30. A fixed-cutter rotary drag bit for drilling subterranean formations, comprising:

a shank;

a bit crown secured to said shank and having a face opposite thereto; and at least one superhard cutting element secured to said crown face;

said at least one superhard cutting element comprising a substantially planar table of superhard material having a flat cutting surface and a cutting edge along at least a portion of the periphery of said cutting surface, and a supporting substrate to the rear of said superhard table, the outer lateral dimension of said substrate extending laterally outwardly beyond said cutting edge.

31. A cutting element for a rotary drag bit used in drilling subterranean formations comprising:

a substantially planar table of superhard material, said superhard table having a flat cutting surface on one side thereof and a cutting edge bordering said cutting surface along at least a portion of the periphery thereof; and a substrate behind, secured to and supporting said superhard table at a side thereof opposite said cutting surface, said substrate extending laterally outwardly beyond said cutting edge.

32. A fixed-cutter rotary drag bit for drilling subterranean formations, comprising:

a shank;

a bit crown secured to said shank and having a face opposite thereto; and at least one superhard cutting element secured to said crown face;

said at least one superhard cutting element comprising a substantially planar table of superhard material having a flat cutting surface and a cutting edge along at least a portion of the periphery of said cutting surface, and a supporting substrate to the rear of said superhard table, the outer lateral dimension of said substrate being substantially the same as that of said superhard table proximate said cutting edge and extending laterally outwardly therefrom from proximate said superhard table.

33. A cutting element for a rotary drag bit used in drilling subterranean formations comprising:

a substantially planar table of superhard material, said superhard table having a flat cutting surface on one side thereof and a cutting edge bordering said cutting surface along at least a portion of the periphery thereof; and a substrate behind, secured to and supporting said superhard table at a side thereof opposite said cutting surface, said substrate being of substantially the same lateral extent than said superhard table proximate said cutting edge and increasing in lateral extent beyond said cutting edge.

* * * * *

UNITED STATES PATENT AND TRADEMARK OFFICE

CERTIFICATE OF CORRECTION

PATENT NO. : 5,460,233

DATED : October 24, 1995

INVENTOR(S) : Meany et al.

It is certified that error appears in the above-indentified patent and that said Letters Patent is hereby corrected as shown below:

In Column 2, line 24, insert a comma after "conditions";

In Column 5, line 55, change "red" to --Red-- and "mountain" to --Mountain--;

In Column 6, line 62, delete the comma after "substrate" and insert a comma after "lip"; and In Column 7, line 5, insert a comma after "612".

Signed and Sealed this

Fifth Day of March, 1996

*Attest:*

Bruce Lehman

BRUCE LEHMAN

*Attesting Officer*

*Commissioner of Patents and Trademarks*